United States Patent [19]

Bowman

[11] 4,181,280

[45] Jan. 1, 1980

[54] BELL ASSEMBLY FOR A CHAIR SUPPORT

[75] Inventor: Vincent G. Bowman, Baden, Canada

[73] Assignee: Faultless-Doerner Manufacturing Inc., Canada

[21] Appl. No.: 884,526

[22] Filed: Mar. 8, 1978

[30] Foreign Application Priority Data

May 18, 1977 [CA] Canada ..... 278736

[51] Int. Cl.[2] ..... F16M 11/00

[52] U.S. Cl. ..... 248/405

[58] Field of Search ..... 108/147; 248/405, 406, 248/354 S; 297/339, 347

[56] References Cited

U.S. PATENT DOCUMENTS

| | | | |
|---|---|---|---|
| 1,699,551 | 1/1929 | Travers | 248/405 X |
| 2,999,665 | 9/1961 | Ericson et al. | 248/405 |
| 3,218,021 | 11/1965 | Michalshi | 248/405 X |
| 3,406,939 | 10/1968 | Doerner | 248/405 |
| 3,606,234 | 9/1971 | Prescott | 248/406 |

*Primary Examiner*—Lawrence J. Staab

*Attorney, Agent, or Firm*—Rogers, Bereskin & Parr

[57] ABSTRACT

A bell assembly is shown for adjusting the height of a chair base. The bell assembly is threaded onto a support post slidably located in a hub and the bell assembly is turned to regulate the height of the support post relative to the hub. The bell assembly includes a spring retaining clip for engagement with the hub to prevent axial separation of the support post and the hub when the chair is lifted. The spring retaining clip includes a C-shaped base portion which engages a bell nut in the bell assembly to prevent longitudinal movement of the retaining clip relative to the bell assembly. The bell assembly also includes a bell housing having a wall portion located adjacent to the retaining clip base portion to prevent rotational movement thereof and disengagement of the retaining clip and bell nut.

9 Claims, 4 Drawing Figures

BELL ASSEMBLY FOR A CHAIR SUPPORT

This invention relates to a bell assembly for a chair support, and in particular to a spring retaining clip mounted inside the bell assembly for preventing longitudinal separation of the bell assembly and a hub of a chair base.

A bell assembly as used in connection with a support or base for a chair or the like is a device which is used to adjust the height from the floor of the chair, etc. The chair support typically includes a chair base having legs or feet resting on the floor and an upright threaded support post slidably located in a hub mounted in the chair base. The chair is mounted on the top of the support post. The bell assembly is threaded onto the support post to abut against the hub of the chair base, so that by turning the bell assembly the height of the support post and thus the chair is regulated.

In order to prevent the support post from being separated from the chair base when the chair is lifted, the bell assembly has in the past included a screw or other type of threaded fastener which engages the hub of the chair base when the support post is moved upwardly. A typical example of the use of such a screw fastener for the prevention of this separation of the chair support is shown in applicant's Canadian Pat. No. 800,375 and the corresponding U.S. Pat. No. 3,406,939. Although this screw fastener type means for preventing separation of the chair support works satisfactorily, the prior art devices generally are more complicated and difficult or time consuming to assemble.

In the present invention, a spring retaining clip in the bell assembly is used to prevent separation of the chair support, and this spring retaining clip is quickly assembled without the use of screw fasteners.

According to the present invention, a bell assembly is provided for adjusting the height of an upright chair support post slidably located in a concentric hub mounted in a chair base. The bell assembly comprises a bell nut threadably mounted on the support post so that the bell nut is adapted to prevent longitudinal downward movement of the support post relative to the hub. A spring retaining clip is removably mounted on a peripheral edge portion of the bell nut, the retaining clip having a base portion and a distal portion spaced below the bell nut and extending radially inwardly for engagement with the hub upon longitudinal separation of the bell nut and hub. The bell nut and retaining clip base portion define co-operating means for preventing longitudinal movement of the retaining clip relative to the bell nut. Also, a bell housing is mounted on the bell nut. The housing has a wall portion located adjacent to the co-operating means for preventing rotational movement of the retaining clip base portion relative to the bell nut.

A preferred embodiment of the invention will now be described, by way of example, with reference to the accompanying drawings, in which.

Figure 1:
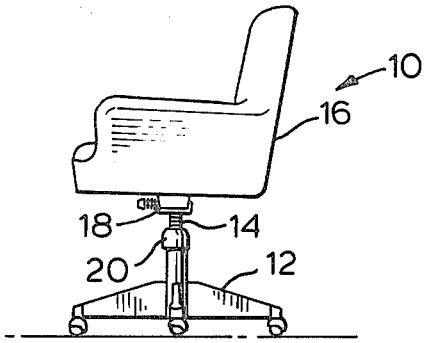
FIG. 1 is an elevational view of a chair having a chair support including a bell assembly according to the present invention.

Referring firstly to FIG. 1, a chair incorporating the present invention is generally indicated by reference numeral 10. Chair 10 includes a chair base 12 having an upright or vertical support post 14 and a seat 16 mounted on the top of support post 14 using a chair control 18 which typically permits the seat to swivel and tilt. These components of chair 10 are conventional and will not be described in further detail. However, the height of support post 14 and thus seat 16 is controlled using a bell assembly 20 according to the present invention, as will be described further below.

Figure 2:
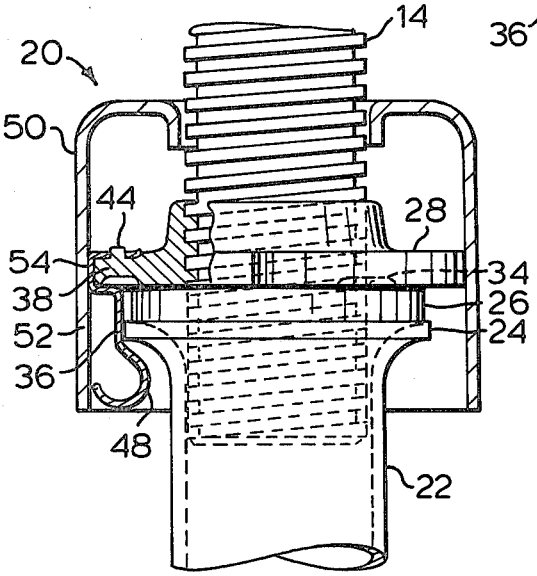
FIG. 2 is a vertical sectional view of the bell assembly incorporated in a chair support as shown in FIG. 1.
Figure 3:
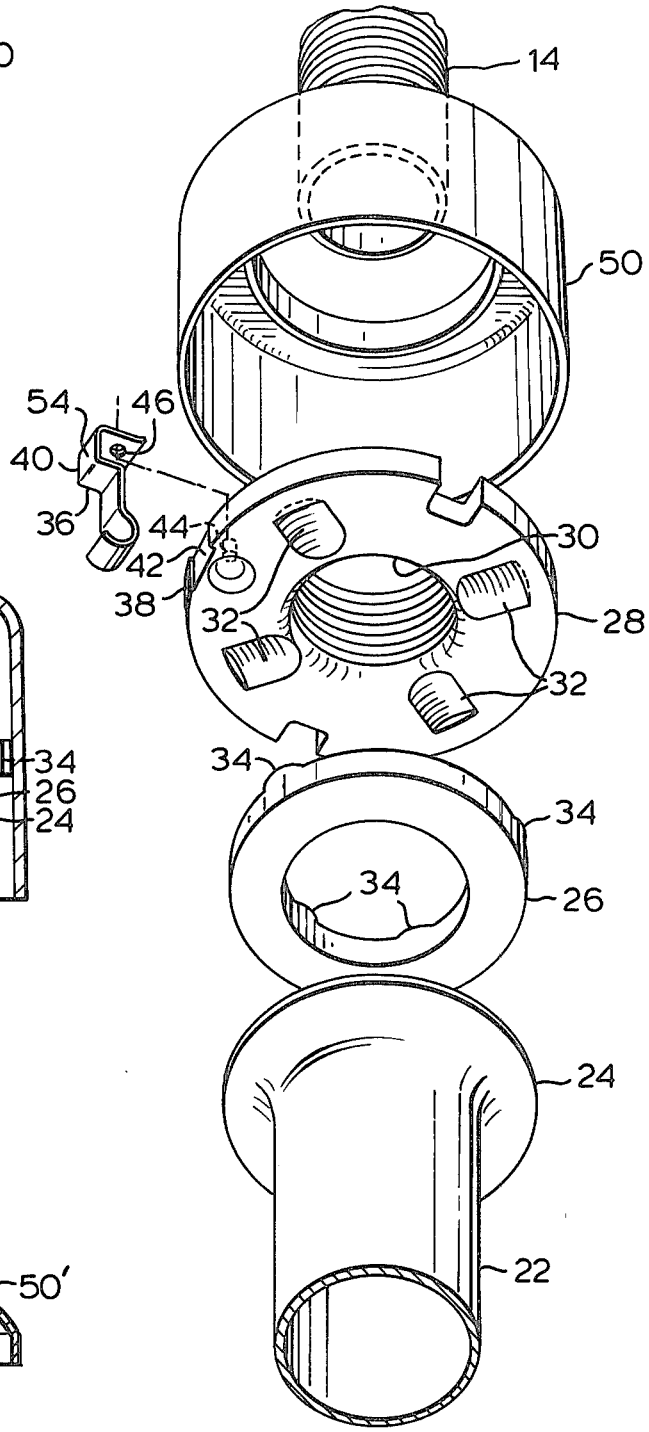
FIG. 3 is an exploded perspective view of the bell assembly and associated chair support components shown in FIG. 2.

Referring next to FIGS. 2 and 3, support post 14 is slidably located in a concentric hub 22, the latter being mounted in and forming part of chair base 12. Hub 22 has an upper end flared portion 24 on which a conventional nylon thrust washer 26 is mounted. A bell nut 28 is located on top of thrust washer 26 and engages thrust washer 26, so that normally bell nut 28 and thrust washer 26 rotate together on top of hub 22 with thrust washer 26 sliding on flared portion 24 of hub 22.

Bell nut 28 includes a central threaded opening 30 for threadably mounting the bell nut on support post 14. The bell nut also includes radially disposed recesses 32 which accommodate corresponding bosses 34 formed on thrust washer 26. Recesses 32 and bosses 34 are normally in registration, so that thrust washer 26 turns with bell nut 28 as the latter is rotated about support post 14. It will be apparent from FIG. 2, that as bell nut 28 is rotated relative to support post 14, the height of support post 14 will be adjusted relative to hub 22 and thus chair base 12 of chair 10. Also, the frictional engagement of the mating threads of bell nut 28 and support post 14 is normally greater than the frictional forces resisting rotation of thrust washer 26 relative to hub 22, so that bell nut 28 normally rotates with support post 14 as the latter is rotated. Support post 14 is usually rigidly connected to chair control 18 or seat 16, so that as the seat is swivelled, bell nut 28 turns with support post 14 and the height of the support post is not altered.

In addition to bell nut 28, bell assembly 20 includes a spring retaining clip 36 which is removably mounted on a peripheral edge portion 38 of bell nut 28. Retaining clip 36 has a base portion 40 which is generally C-shaped and is located in a corresponding recess 42 formed in peripheral edge portion 38 of bell nut 28. Base portion 40 of retaining clip 36 and peripheral edge portion 38 of bell nut 28 co-operate to prevent longitudinal movement of retaining clip 36 relative to the bell nut. An upright retaining lug 44 is transversely formed in peripheral edge portion 38 by swaging, and a mating recess or opening 46 is formed in base portion 40 of retaining clip 36, so that when the retaining clip is mounted on the bell nut, transverse lug 44 prevents the retaining clip from moving radially outward without lifting the engaging portion of base portion 40 over lug 44. Spring retaining clip 36 also includes a generally C-shaped distal portion 48 spaced below the bell nut and which extends radially inwardly so that distal portion 48 engages the hub flared portion 24 upon longitudinal separation of the bell nut and hub. Thus it will be apparent that spring retaining clip 36 prevents support post 14 from becoming separated from hub 22 when seat 16 (support post 14) is lifted.

Bell assembly 20 also includes a bell housing 50 in the form of an inverted cup which is press fitted onto bell nut 28. It will be appreciated therefore, that when bell housing 50 is turned relative to support post 14, bell nut 28 also rotates relative to the support post thereby adjusting the height of the seat 16 relative to base 12. Bell housing 50 also has a wall portion 52 (FIG. 2) located adjacent to retaining clip 36. This wall portion 52 is located adjacent to and abuts against a flat portion 54 of retaining clip base portion 40 and also distal portion 48 to prevent rotational movement of the retaining clip base portion relative to the bell nut. Thus, as bell assembly 20 is raised relative to hub 22 the tendency for retaining clip 36 to be deflected or rotated outwardly by flared portion 24 is resisted by the wall portion of bell housing 50. If bell housing wall portion 52 did not abut against retaining clip flat portion 54, retaining clip 36 could be distorted and caused to become demounted from bell nut 28 in the event that excessive force was used to separate support post 14 from hub 22.

Figure 4:
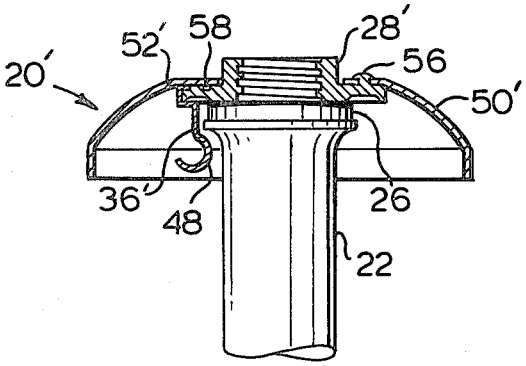
FIG. 4 is a vertical sectional view of another embodiment of a bell assembly according to the present invention and some of its associated chair support components.

Referring next to FIG. 4, another embodiment of a bell assembly according to the present invention is shown, primed reference numerals being used to indicate parts similar to the embodiments shown in FIGS. 2 and 3. In the embodiment shown in FIG. 4, the bell housing 50' is wider and shallower and is not press fitted onto bell nut 28'. Instead, bell housing 50' is held in position by a rivet 56 which is integrally formed in bell nut 28' by swaging and which is located in a corresponding opening formed in bell housing 50'. It will also be noted that wall portion 52' of bell housing 50' is located adjacent to and abuts against a top flat part 58 of retaining clip 36' to prevent any tendency for rotational movement of the base portion of the retaining clip. In view of the fact that wall portion 52' is not located adjacent to distal portion 48' of retaining clip 36', this retaining clip is made of slightly thicker material than retaining clip 36 shown in FIG. 2 to ensure that bell assembly 20' and hub 22 do not become longitudinally separated by the normal lifting of seat 16. In the preferred embodiment, spring retaining clip 36 is typically formed from 5/16 inch width spring steel having a thickness of 0.020 inches, and spring retaining clip 36' is typically of the same width, but of 0.040 inches in thickness. In either case, it will be appreciated that a certain amount of deflection of spring retaining clips 36, 36' is desirable, as long as this deflection does not exceed the elastic limit of the retaining clips, in order to facilitate assembly and disassembly or demounting of the chair base if desired.

Having described preferred embodiments of the invention, it will be appreciated that various modificiations may be made to the structures described. For example, transverse retaining lug 44 formed in the peripheral edge portion of the bell nut may be eliminated if desired. However, these retaining lugs ensure that the spring retaining clips will be easily positioned and remain in position during assembly of the bell assembly. Alternatively, the C-shaped base portion of the retaining clip could be made with a close sliding fit or a snug fit to act as a sort of clamp on the bell nut peripheral edge portion for this purpose, but with the use of the transverse retaining lugs it is not necessary to have close tolerances for the spring retaining clips.

Another modification that could be made is that the transverse retaining lugs could be formed in the base portion of the retaining clips, and corresponding mating recesses could be formed in the peripheral edge portion of the bell nut, rather than vice versa as in the preferred embodiment.

It will also be apparent to those skilled in the art that the bell assembly according to the present invention could be used in connection with supports or bases for articles other than chairs, for example, tables or the like.

From the above, it will be appreciated that the bell assembly of the present invention is a very simple and effective structure that is easy to assemble and neat in appearance as well.

What I claim is:

1. A bell assembly for adjusting the height of an upright chair support post slidably located in a concentric hub mounted in a chair base, the bell assembly comprising:

a bell nut threadably mounted on said support post and adapted to prevent longitudinal downward movement of said support post relative to said hub;

a spring retaining clip removably mounted on a peripheral edge portion of the bell nut, the retaining clip having a base portion which is generally C-shaped and which engages said bell nut peripheral edge portion, and a distal portion spaced below the bell nut and extending radially inwardly for engagement with said hub upon longitudinal movement between the bell nut and hub for preventing separation of the support post and hub; and, a bell housing mounted on the bell nut, said housing having a wall portion located adjacent to said spring retaining clip for preventing rotational movement of the clip base portion relative to the bell nut.

2. A bell assembly as claimed in claim 1 wherein said co-operating means further includes a transverse lug formed in one of said bell nut peripheral edge portion and the retaining clip base portion, and the other of said bell nut peripheral edge portion and retaining clip base portion defining an opening to accommodate said lug to prevent radial movement of the retaining clip relative to the bell nut.

3. A bell assembly as claimed in claim 2 wherein said transverse lug is formed in the bell nut peripheral edge portion, and wherein the retaining clip base portion defines said opening to accommodate the lug.

4. A bell assembly as claimed in claim 1 wherein said C-shaped base portion has a flat portion, and wherein said bell housing wall portion abuts against said flat portion to prevent rotation of the base portion.

5. A bell assembly as claimed in claim 1 wherein said bell nut peripheral edge portion defines a recess, said C-shaped retaining clip base portion being located in said recess.

6. A bell assembly as claimed in claim 5 wherein the bell housing is in the form of an inverted cup press-fitted onto the bell nut, so that said housing wall portion abuts against the retaining clip base portion located in said recess.

7. A bell assembly as claimed in claim 1 wherein said bell housing wall portion is located adjacent to said distal portion of the retaining clip to prevent radial outward movement of said distal portion beyond said wall portion.

8. A bell assembly as claimed in claim 1 wherein the spring retaining clip is formed of generally flat spring steel material.

9. A bell assembly for adjusting the height of an upright chair support post slidably located in a concentric hub mounted in a chair base, the bell assembly comprising:

a bell nut threadably mounted on said support post and adapted to prevent longitudinal downward movement of said support post relative to said hub;

a spring retaining clip mounted on and coupled to a peripheral edge portion of the bell nut, the retaining clip having: a base portion which includes a flat portion disposed in surface contact with said nut; and a distal portion spaced below the bell nut and extending radially inwardly for engagement with said hub upon longitudinal movement between the bell nut and hub for preventing separation of the support post and hub; and, a bell housing mounted on the bell nut, said housing having a wall portion located adjacent to and abutting against said retaining clip flat portion so as to trap said portion against the nut and prevent distortion of the clip tending to cause the clip to be demounted from the bell nut.

* * * * *